US005294400A

United States Patent [19]

Peterson et al.

[11] Patent Number: 5,294,400

[45] Date of Patent: Mar. 15, 1994

[54] CORROSION PREVENTION IN BOILERS USING 1,3-IMIDAZOLE

[75] Inventors: Richard A. Peterson; Robert J. Webb, both of Naperville, Ill.

[73] Assignee: Nalco Chemical Company, Naperville, Ill.

[21] Appl. No.: 39,617

[22] Filed: Mar. 30, 1993

[51] Int. Cl.[5] ..... C23G 26/00

[52] U.S. Cl. ..... 422/16; 422/14; 252/390; 252/394

[58] Field of Search ..... 422/14, 16; 252/390, 252/394

[56] References Cited

U.S. PATENT DOCUMENTS 4,098,720 7/1978 Hwa ..... 422/16

*Primary Examiner*—Robert J. Warden
*Assistant Examiner*—Timothy M. McMahon
*Attorney, Agent, or Firm*—Robert A. Miller; John G. Premo

[57] ABSTRACT 1.3-imidazole prevents the corrosion of metal surfaces in contact with boiler waters and the condensates produced from these waters.

4 Claims, 2 Drawing Sheets

CONDENSATE pH vs TIME: IMIDAZOLE + $KHCO_3$ IN FEEDWATER (250 psig, 10 CYCLES)

CONDENSATE pH vs TIME: IMIDAZOLE + $KHCO_3$ IN FEEDWATER (250 psig, 10 CYCLES)

EFFECT OF 1,3 IMIDAZOLE ON CONDENSATE pH IN THE PRESENCE OF $KHCO_3$

CORROSION PREVENTION IN BOILERS USING 1,3-IMIDAZOLE

FIELD OF THE INVENTION

This invention relates to the prevention of corrosion of metal surfaces in contact with boiler waters or their condensates.

INTRODUCTION

In the work, the Nalco Water Handbook, Second Ed. Frank N. Kemmer, Editor Mc Graw Hill, 1987, Chapter 39 deals with the subject of treating boiler waters to prevent deposits and corrosion. A special problem in the treatment of boilers is the prevention of corrosion of the metal surfaces of the condensate return systems. Boiler water condensates are corrosive because they are contaminated with carbon dioxide and oxygen. These agents render the hot condensate corrosive and aggressive to such metals as iron, and copper.

The most common method of preventing condensate corrosion is to treat the condensate with neutralizing amines to raise the pH of the condensate. For a discussion of the use of neutralizing amines to combat condensate corrosion, reference may be had to the Nalco Water Handbook, specifically page 39.55. This work and its description of boiler corrosion problems is incorporated herein by reference. These amines may be fed to the boiler feed water after deaeration, to the boiler steam drum or to the steam header. While these amines have given satisfactory results in preventing condensate corrosion they are falling in to disfavor due their relatively high level of toxicity.

Until the present invention condensate inhibitors were usually used to prevent condensate corrosion only. The prevention of the corrosion of metal surfaces in contact with boiler waters has normally required the use of inhibitors different in kind from those used to prevent condensate corrosion. Typically, sulfites and hydrazine have been used to combat boiler water corrosion problems.

Advances in the art of preventing the corrosion of metal surfaces of boilers and their condensate return systems would be afforded if there were available a condensate corrosion inhibitor having a low order of toxicity which would also protect metal surfaces in contact with boiler waters. Of further benefit would be an inhibitor as generically described which would be stable under conditions of the high pressures found in commercial boilers which range from as little as 150 pounds per square inch (psi) up to as great as high as 1500–2000 psi. These advances in the art are accomplished by using 1,3-imidazole as the inhibiting agent.

PRIOR ART 1,3-imidazole has been suggested as a corrosion inhibitor for mild steel in alkaline mine waters: see Subramanyam, ND. and Mayanna, S. M. "Azoles as Corrosion Inhibitors for Mild Steel in Alkaline Mine Waters," *Corrosion Science,* 25 (3), 169–9 1985. It is apparent to those skilled in the art that the environment encountered in boilers, and especially in condensate return systems, is very different than the environment of mine waters. It would not be obvious that 1,3-imidazole would be effective in treating boilers and their condensate systems.

THE INVENTION

In its broadest aspect the invention comprises a method of inhibiting the corrosion of metal surfaces in contact with boiler waters and the condensate produced therefrom which comprises treating the boiler waters or the condensate with a corrosion inhibiting amount of 1,3-imidazole. The 1,3-imidazole is effective in preventing condensate corrosion under proper conditions.

While the 1,3-imidazole may be added to the boiler at any number of points where prior art neutralizing inhibitors have been fed to obtain maximum benefit from the inhibitor it is preferred that it be added to the boiler feed in the form of a dilute aqueous solution. By adding the 1,3-imidazole to the feedwater it is possible to protect metal surfaces in contact with the boiler water and the condensate against corrosive attack.

The amount of 1,3-imidazole necessary to prevent condensate corrosion, and the amount necessary to passivate metal surfaces in contact with the boiler water may vary. In some cases as little as 0.5 parts per million (ppm) by weight of the 1,3-imidazole, based on the weight of the boiler water, will produce satisfactory results. Generally the dosage will range between 5–50 ppm with between 5–25 ppm being a typically effective range.

EVALUATION OF THE INVENTION

The tests illustrating the efficacy of the 1,3-imidazole as a condensate inhibitor were conducted using a laboratory scale boiler which duplicated the conditions of a full size unit. The results of these tests are presented hereafter.

EXAMPLE 1

Figure 1:
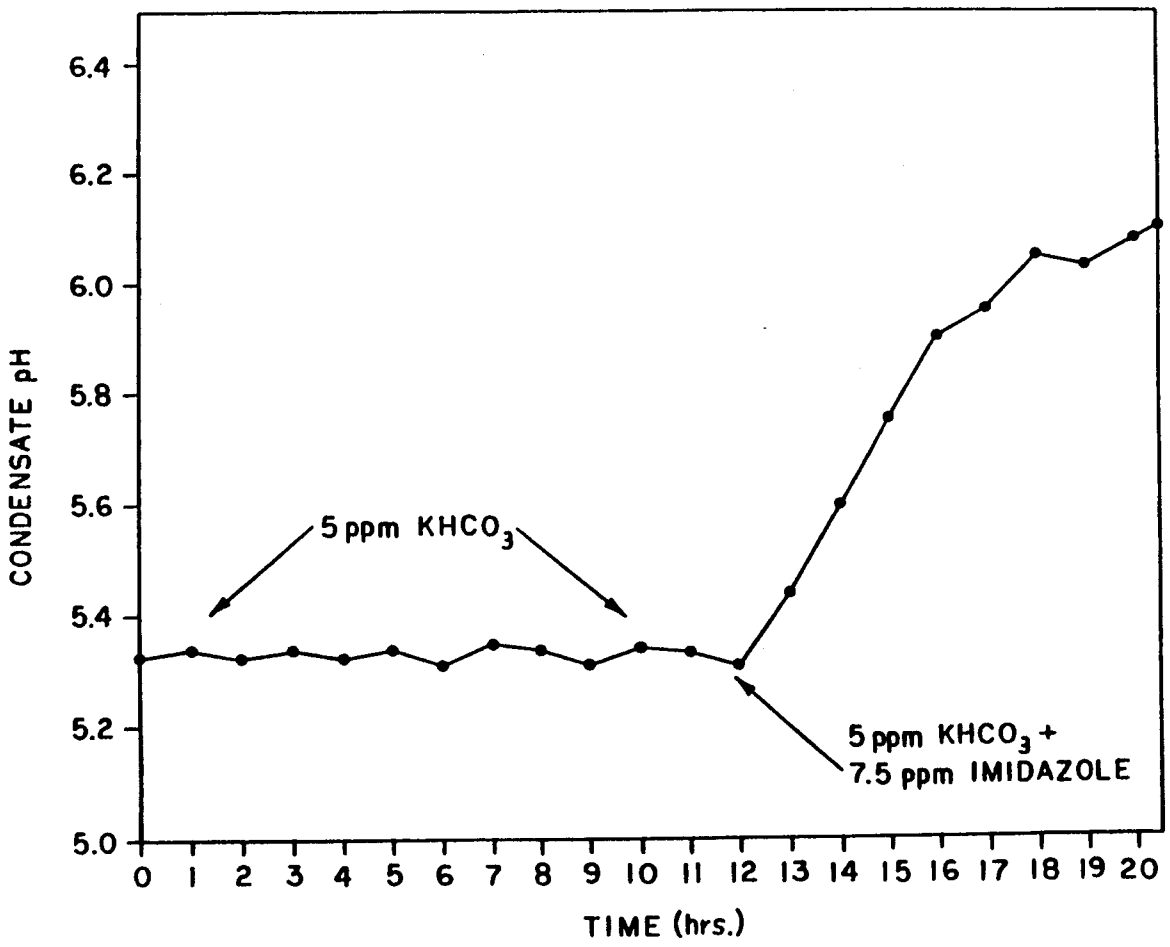
FIG. 1 shows the effectiveness of 1,3-imidazole added to a boiler feed water of a boiler operated at a 250 psi.

This test was conducted at 250 psi. The boiler was run for ten cycles. By feeding a combination of potassium carbonate with 1,3-imidazole versus potassium hydrogen carbonate alone a substantial increase in pH was achieved. This is shown in FIG. 1.

EXAMPLE 2

Figure 2:
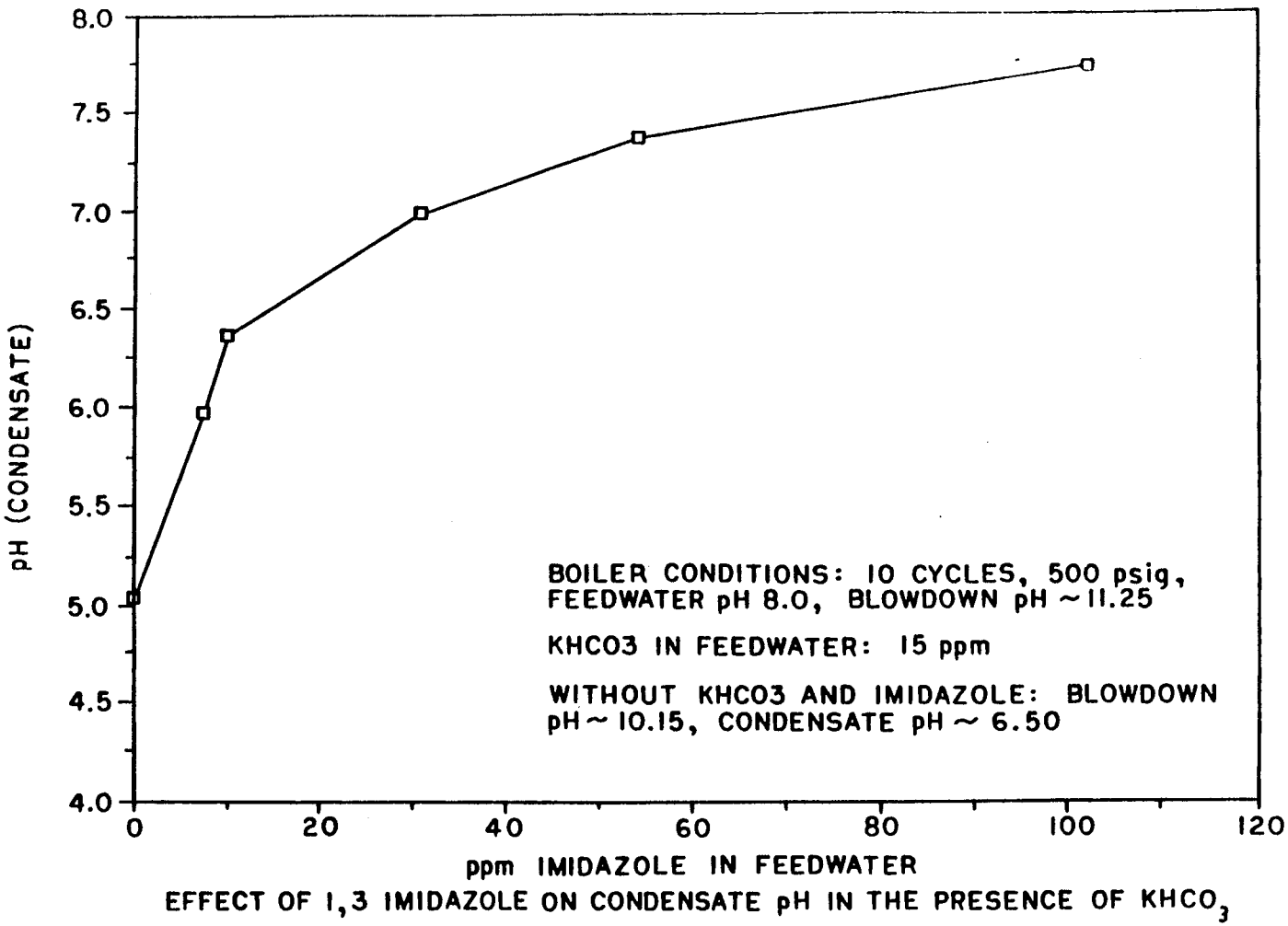
FIG. 2 shows the effectiveness of the 1,3-imidazole added to a boiler feed water of a boiler operated at a pressure of 500 psi.

The same test procedure as in Example 1 except the pressure of the boiler was 500 psi. Further details of the experiment as well as the superior results achieved using 1,3-imidazole are shown to good advantage in FIG. 2.

EXAMPLE 3

The blowdown of boiler water treated with 1,3-imidazole showed the iron to remain below 50 parts per billion while the treatment was in effect. This illustrates the ability of 1,3-imidazole to control the corrosion of ferrous metals in contact with boiler waters as well as controlling condensate corrosion.

Having thus described our invention it is claimed as follows:

1. A method of inhibiting the corrosion of ferrous metal surfaces in contact with boiler waters and the condensate produced therefrom which comprises adding to the boiler waters or the condensate with a corrosion inhibiting amount of a composition consisting essentially of 1,3-imidazole.

2. The method of inhibiting the corrosion of ferrous metal surfaces of boiler condensate return systems in contact with boiler water condensate which comprises adding to these condensates a corrosion inhibiting amount of a composition consisting essentially of 1,3-imidazole.

3. The method of claim 1 where the 1,3-imidazole is added to the boiler feed water.

4. The method of claim 2 where the 1,3-imidazole is added to the condensate.

* * * * *